US005984210A

United States Patent [19]

Forck et al.

[11] Patent Number: 5,984,210

[45] **Date of Patent: *Nov. 16, 1999**

[54] FUEL INJECTOR UTILIZING A SOLENOID HAVING COMPLEMENTARILY-SHAPED DUAL ARMATURES

[75] Inventors: Glen F. Forck; Umesh Shah, both of Peoria, Ill.

[73] Assignees: Caterpillar Inc., Peoria, Ill.; Lucas Industries PLC, Solihull, United Kingdom

[ * ] Notice: This patent is subject to a terminal disclaimer.

[21] Appl. No.: 08/964,157

[22] Filed: Nov. 4, 1997

[51] Int. Cl.[6] ..... B05B 1/30; F02M 47/02

[52] U.S. Cl. ..... 239/585.1; 239/585.3; 239/585.2; 239/585.4; 239/91

[58] Field of Search ..... 239/585.1, 585.2, 239/585.3, 585.4, 585.5, 91, 96; 137/596.17, 870

[56] References Cited

U.S. PATENT DOCUMENTS

| | | | |
|---|---|---|---|
| 3,378,031 | 4/1968 | Hatashita | 137/596.17 |
| 3,585,458 | 6/1971 | Yoshimura | 317/156 TR |
| 4,053,137 | 10/1977 | Raymond | 251/65 |
| 4,279,520 | 7/1981 | Heath | 400/124 |
| 4,540,965 | 9/1985 | Hattori et al. | 335/259 |
| 4,715,542 | 12/1987 | Morell et al. | 239/533 |
| 4,782,315 | 11/1988 | Bataille et al. | 335/234 |
| 4,808,955 | 2/1989 | Godkin et al. | 335/222 |
| 4,910,486 | 3/1990 | Yumura et al. | 335/222 |
| 4,951,023 | 8/1990 | Erd et al. | 335/222 |
| 4,964,571 | 10/1990 | Taue et al. | 239/585.4 X |
| 5,200,727 | 4/1993 | Katoh et al. | 335/222 |
| 5,345,206 | 9/1994 | Morcos | 335/222 |
| 5,433,385 | 7/1995 | Sakagami et al. | 239/585.1 |
| 5,551,480 | 9/1996 | Tomatsu et al. | 137/625.29 |
| 5,673,669 | 10/1997 | Maley et al. | 239/96 X |
| 5,680,988 | 10/1997 | Patil et al. | 239/94 X |
| 5,697,342 | 12/1997 | Anderson et al. | 239/96 X |

FOREIGN PATENT DOCUMENTS 1102329 2/1968 United Kingdom .

*Primary Examiner*—Andres Kashnikow
*Assistant Examiner*—Robin O. Evans
*Attorney, Agent, or Firm*—William E. McCracken; Marshall, O'Toole, Gerstein, Murray & Borun

[57] ABSTRACT

A fuel injector includes a solenoid having two armatures which are complementarily shaped to define a stepped armature gap.

20 Claims, 4 Drawing Sheets

FUEL INJECTOR UTILIZING A SOLENOID HAVING COMPLEMENTARILY-SHAPED DUAL ARMATURES

TECHNICAL FIELD

The present invention relates generally to fuel injection apparatus, and more particularly to a fuel injector utilizing a solenoid as an actuator.

BACKGROUND ART

Fuel injected engines employ fuel injectors, each of which delivers a metered quantity of fuel to an associated engine cylinder during each engine cycle. Prior fuel injectors were of the mechanically or hydraulically actuated type with either mechanical or hydraulic control of fuel delivery. More recently, electronically controlled fuel injectors have been developed. In the case of a mechanically actuated electronic unit injector, fuel is supplied to the injector by a transfer pump. The injector includes a plunger which is movable by a cam-driven rocker arm to compress the fuel delivered by the transfer pump to a high pressure. An electrically operated mechanism either carried outside the injector body or disposed within the injector proper is then actuated to cause fuel delivery to the associated engine cylinder.

In prior fuel injector designs, high pressure fuel is conducted through passages which are located outside of a central recess containing a solenoid which operates a valving mechanism. The passages are located close to the outer surface of the fuel injector and are formed by drilling intersecting holes. After drilling, portions of some of the holes must be filled with plugs. These passages and plugs are subjected to very high fluid pressures, thus requiring careful design and increasing complexity and cost.

In addition to the foregoing, because the high pressure passages are located outside of the solenoid, the size of the solenoid is necessarily limited, thereby limiting the available solenoid force.

Still further, a prior type of fuel injector utilizes a direct operated check valve, which includes upper and lower valve seats which must be precisely aligned for proper operation. Manufacturing and assembly tolerances must, therefore, be kept tight, further increasing cost.

SUMMARY OF THE INVENTION

A solenoid for a fuel injector has a design which permits fuel flow to be directed substantially coincident with the central axis of the fuel injector, thereby avoiding the disadvantages noted above.

More particularly in accordance with one aspect of the present invention, a fuel injector solenoid includes a stator having first and second axially-spaced outer arms and a solenoid coil disposed in the stator. First and second axially adjacent armatures are disposed between the outer arms and include complementary surfaces defining a non-axial armature gap between the armatures wherein the armatures are movable in an axial direction away from one another in response to current flowing in the solenoid coil.

Preferably, the first and second outer arms include first and second stator faces opposite first and second armature faces, respectively, to define first and second air gaps. Also preferably, the complementary surfaces comprise opposed radial surfaces which may define a single step or a plurality of steps.

Also preferably, a flux blocking element is disposed between the armatures and, more particularly may be disposed between axial surfaces of the complementary surfaces.

In accordance with the further aspect of the present invention, a fuel injector solenoid includes a stator having first and second outer arms and a solenoid coil disposed in the stator. First and second axially adjacent armatures are disposed between the outer arms and include complementary stepped surfaces defining an armature gap between the armatures. The armatures are movable in an axial direction away from one another in response to current flowing in the solenoid coil.

In accordance with yet another aspect of the present invention, a fuel injector solenoid includes a stator having first and second outer arms and a solenoid coil disposed in the stator. First and second axially adjacent armatures are disposed between the outer arms and include complementary step surfaces including opposed radial surfaces and opposed axial surfaces together defining an armature gap between the armatures. The armatures are movable in an axial direction away from one another in response to current flowing in the solenoid coil. The first and second outer arms include first and second stator faces opposite first and second armature faces, respectively, to define first and second air gaps. A radial flux path having a first reluctance extends between the opposed radial surfaces and an axial flux path having a second reluctance greater than the first reluctance extends between the opposed axial surfaces.

The present invention permits the high pressure fuel passage to be placed at the center line of the injector, using a valving structure which avoids the need for intersecting holes and plugs and which avoids the valve alignment problems noted above. Further, more space can be made available for other components, such as an external wiring connector.

BEST MODE FOR CARRYING OUT THE INVENTION

Figure 1:
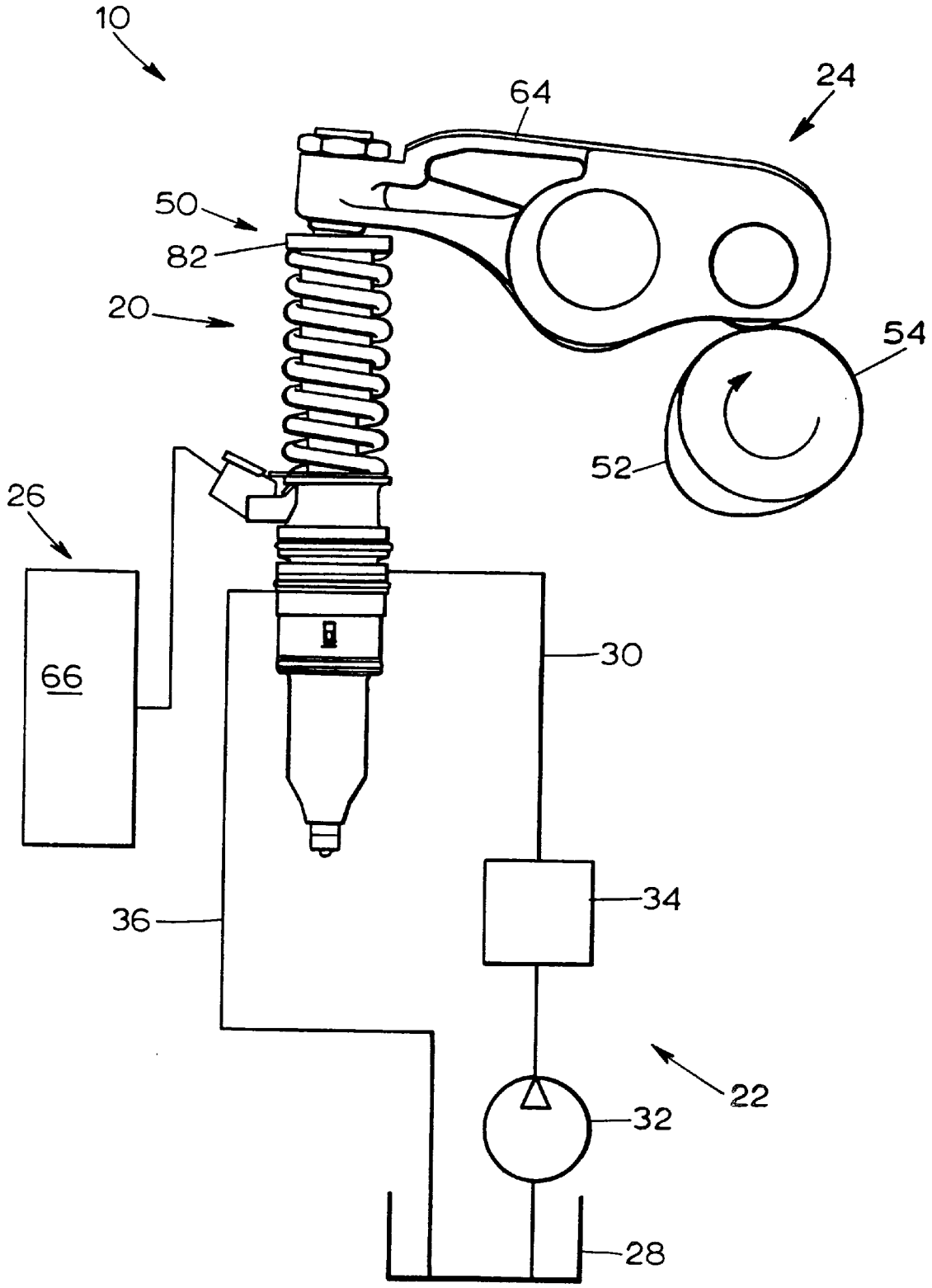
FIG. 1 is an elevational view of a fuel injector incorporating the present invention together with a cam shaft and rocker arm and further illustrating a block diagram of a transfer pump and an electronic control module for controlling the fuel injector.

Referring to FIG. 1, a portion of a fuel system 10 is shown adapted for a direct-injection diesel-cycle reciprocating internal combustion engine. However, it should be understood that the present invention is also applicable to other types of engines, such as rotary engines or modified-cycle engines, and that the engine may contain one or more engine combustion chambers or cylinders. The engine has at least one cylinder head wherein each cylinder head defines one or more separate injector bores, each of which receives an injector 20 according to the present invention.

The fuel system 10 further includes apparatus 22 for supplying fuel to each injector 20, apparatus 24 for causing each injector 20 to pressurize fuel and apparatus 26 for electronically controlling each injector 20.

The fuel supplying apparatus 22 preferably includes a fuel tank 28, a fuel supply passage 30 arranged in fluid communication between the fuel tank and the injector 20, a relatively low pressure fuel transfer pump 32, one or more fuel filters 34 and a fuel drain passage 36 arranged in fluid communication between the injector 20 and the fuel tank 28. If desired, fuel passages may be disposed in the head of the engine in fluid communication with the fuel injector 20 and one or both of the passages 30 and 36.

The apparatus 24 may be any mechanically-actuating device or hydraulically-actuating device. In the embodiment shown a tappet and plunger assembly 50 associated with the injector 20 is mechanically actuated indirectly or directly by a cam lobe 52 of an engine-driven cam shaft 54. The cam lobe 52 drives a pivoting rocker arm assembly 64 which in turn reciprocates the tappet and plunger assembly 50. Alternatively, a push rod (not shown) may be positioned between the cam lobe 52 and the rocker arm assembly 64.

The electronic controlling apparatus 26 preferably includes an electronic control module (ECM) 66 which controls: (1) fuel injection timing; (2) total fuel injection quantity during an injection cycle; (3) fuel injection pressure; (4) the number of separate injection segments during each injection cycle; (5) the time interval(s) between the injection segments; and (6) the fuel quantity delivered during each injection segment of each injection cycle.

Preferably, each injector 20 is a unit injector which includes in a single housing apparatus for both pressurizing fuel to a high level (for example, 207 MPa (30,000 p.s.i.)) and injecting the pressurized fuel into an associated cylinder. Although shown as a unitized injector 20, the injector could alternatively be of a modular construction wherein the fuel injection apparatus is separate from the fuel pressurization apparatus.

Figure 2:
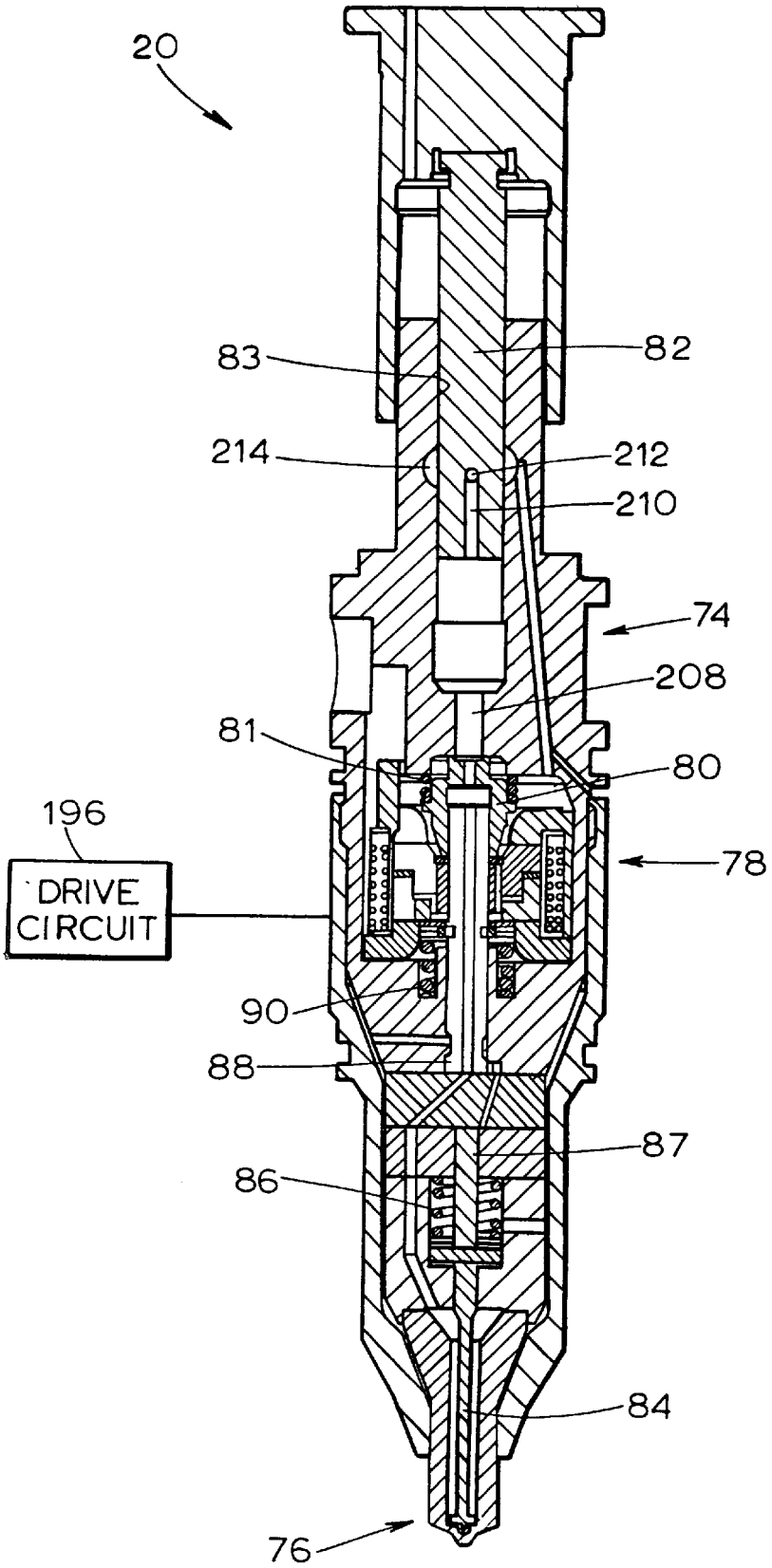
FIG. 2 is a fragmentary sectional view of the fuel injector of FIG. 1.
Figure 3:
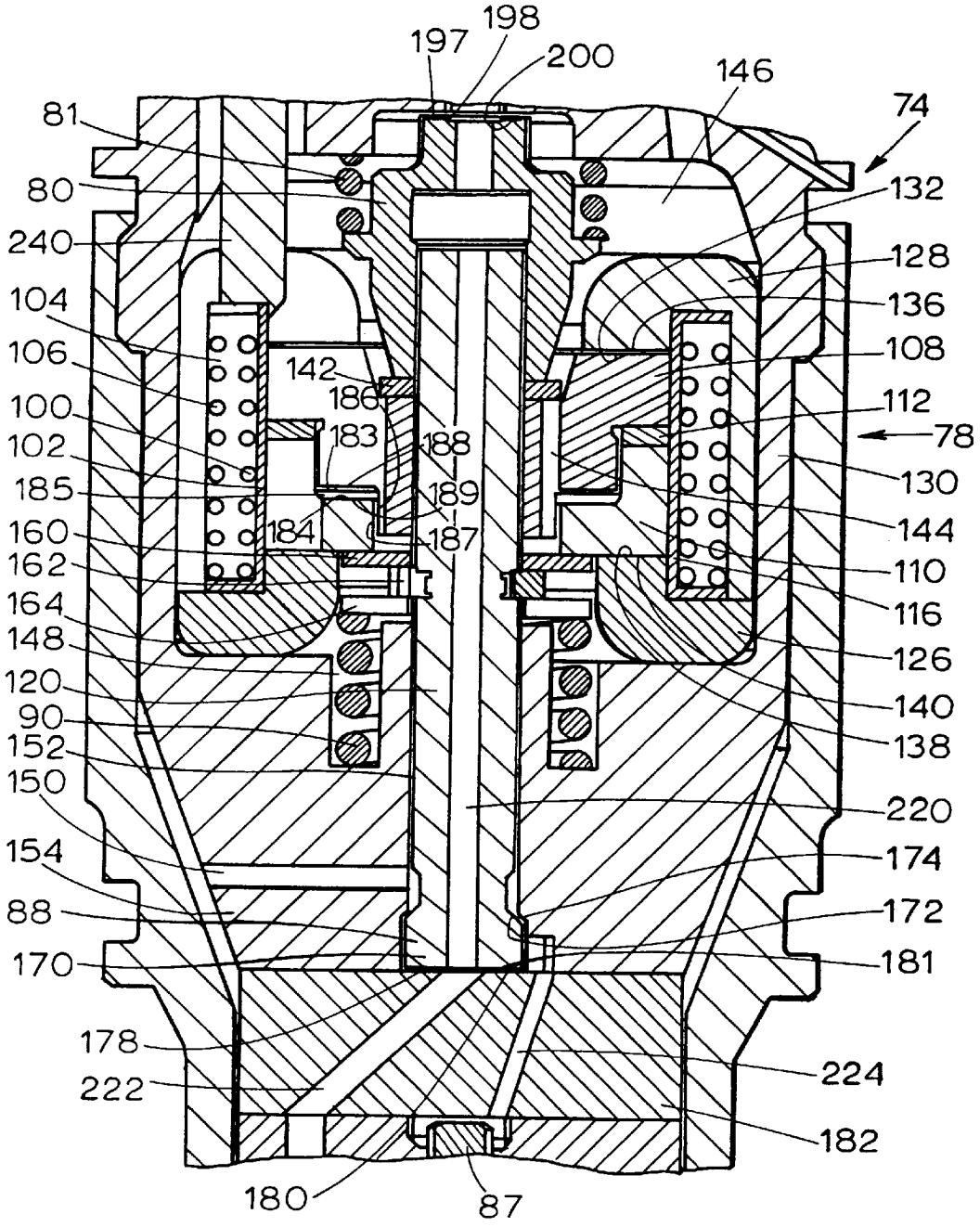
FIG. 3 is an enlarged, fragmentary sectional view of the fuel injector of FIG. 2 illustrating the solenoid, high pressure spill valve and DOC valve in greater detail.

Referring now to FIGS. 2 and 3, the injector 20 includes a case 74, a nozzle portion 76, an electrical actuator 78, a spill valve 80, a spill valve spring 81, a plunger 82 disposed in a plunger cavity 83, a check 84, a check spring 86 surrounding a check piston 87 (which forms a check assembly with the check 84), a direct operated check (DOC) valve 88 and a DOC spring 90. In the preferred embodiment, the spill valve spring 81 exerts a first spring force when compressed whereas the DOC spring 90 exerts a second spring force greater than the first spring force when compressed.

Referring specifically to FIG. 3, the electrical actuator 78 comprises a solenoid 100 for controlling the valves 80, 88. The solenoid 100 includes a stator 102 having a recess 104 within which is disposed a solenoid coil 106. The solenoid 100 further includes an armature assembly comprising first and second annular armatures 108, 110, respectively, which are disposed on either side of an annular central spacer member 112 fabricated of nonmagnetic (i.e., high reluctance) material. The spacer member 112 may be free of attachment to other structures or may be secured to either of the armatures 108, 110 or may be secured to a coil bobbin 116 retained within the stator 102. The first and second armatures 108, 110 surround an axially movable central tube 120, as do the first valve 80 and the central spacer member 112.

The solenoid stator 102 includes first and second outer legs 126, 128, respectively, and a center leg 130 which together define a C-shape in cross-section. A face 132 of the outer leg 128 and a face 136 of the armature 108 define a first airgap whereas a second airgap is defined by opposed faces 138, 140 of the outer leg 126 and the armature 110, respectively. The first armature 108 contacts a washer 142 which in turn abuts the spill valve 80. A passage 144 allows for fluid communication between a valve recess 146 containing the spill valve 80 and a further recess 148. The recess 146 is in fluid communication with fuel supply passages (not shown). A drain passage 150 is in fluid communication with drain through a further passage (not shown).

The second armature 110 contacts a washer 160, which in turn abuts a retaining ring 162 located in a groove in the central tube 120. A washer 164 contacts the retaining ring 162 and is urged thereagainst by the DOC spring 90. The central tube 120 includes a portion 170 defining the DOC valve 88. The portion 170 includes a surface 172 defining a conical sealing surface which can seat against a complimentary conical valve seat 174 formed in the body member 154. (The outer diameter of the portion 170 is slightly greater than the diameter of the bore containing the central tube 120 above the seat 174.) The portion 170 further includes a lower conical poppet surface 178 defining an outer knife edge 180 which is disposed opposite a flat valve seat 181 of a further body member 182.

The first and second armatures 108, 110 include complementary surfaces 183, 184 defining an armature gap 185. Preferably, the surfaces 183, 184 are stepped, i.e., each surface 183, 184 includes one or more radial surfaces 186, 187 and axial surfaces 188, 189, respectively, together defining a stepped armature gap comprising one or more steps. If desired, the complementary surfaces 183, 184 may define an armature gap having at least one non-axial portion, such as a conical armature gap portion. The reluctance in each path between opposed radial faces 186, 187 is less than the reluctance in each path between opposed axial faces 188, 189. This relationship is achieved by use of the spacer member 112, which comprises a high-reluctance (i.e., flux blocking) member between the axial faces 188, 189. At the same time, the airgap between the radial faces 186, 187 is kept short, and the distances over which the radial faces 186, 187 overlap is kept relatively long, even while the armatures 108, 110 are axially displaced from one another by the maximum distance (i.e., when the solenoid is actuated by a maximum current level). Any other means by which this reluctance relationship is maintained may be alternatively used. Such an armature configuration allows flux to pass in the non-axial direction between the armatures 108, 110, and further blocks axial flux passage between the armatures 108, 110 so that the armature motive force is maximized for a given solenoid size.

Industrial Applicability

Figure 4:
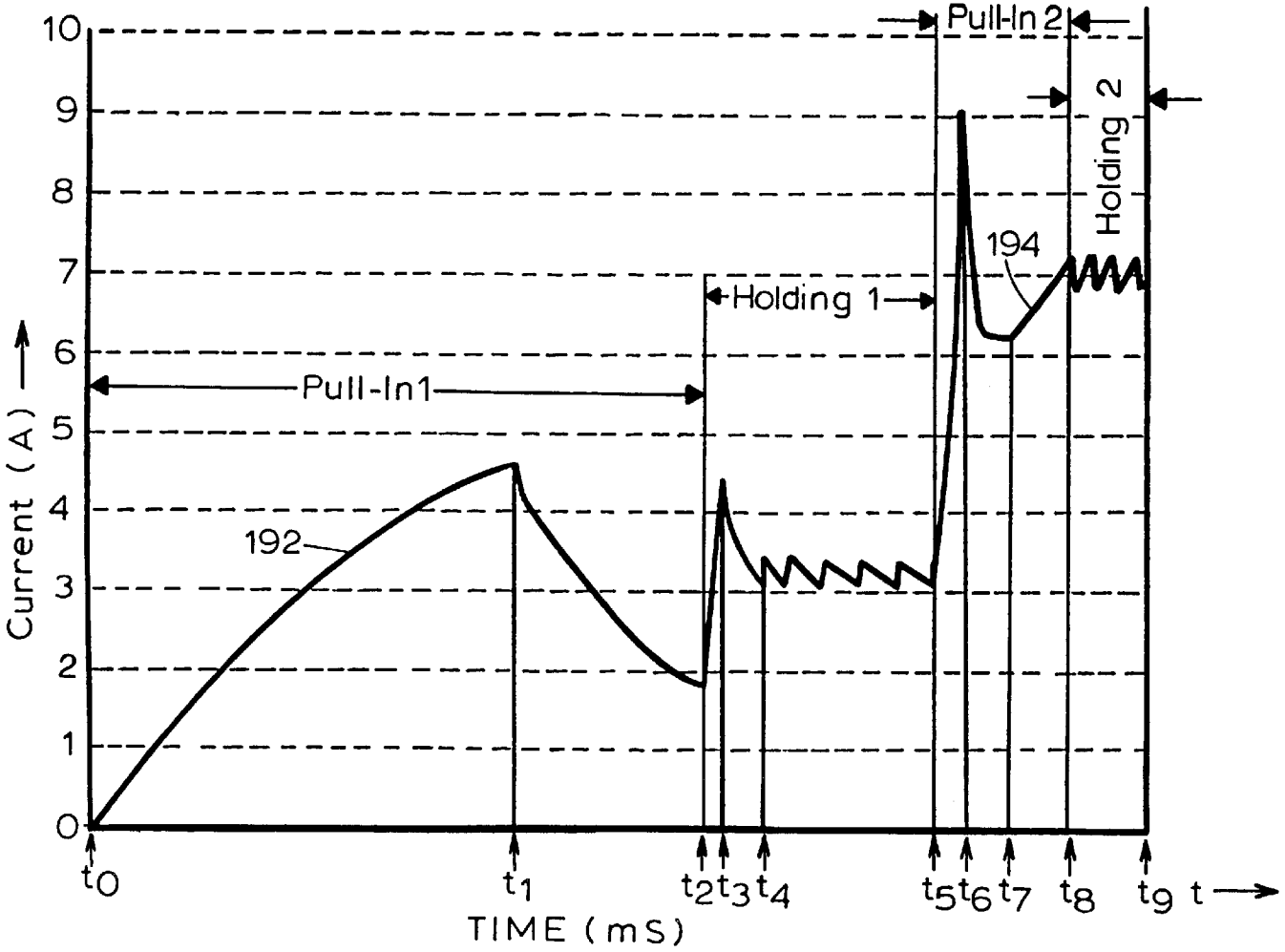
FIG. 4 is a waveform diagram illustrating current waveforms supplied to the solenoid coil of FIGS. 2 and 3.

FIG. 4 illustrates current waveform portions 192, 194 applied by a drive circuit 196 to the solenoid winding 106 during a portion of an injection sequence to accomplish fuel injection. The first current waveform portion 192 is applied between times $t=t_0$ and $t=t_5$ and the second current waveform portion 194 is applied subsequent to the time $t=t_5$. Between time $t=t_0$ and time $t=t_2$, a first pull-in current is provided to the solenoid winding 106 and a first holding current at somewhat reduced levels is thereafter applied between times $t=t_2$ and $t=t_5$. A second pull-in current generally of greater magnitude than the first pull-in current level is applied between times $t=t_5$ and $t=t_8$ and a second holding current generally greater in magnitude than the first holding current level is applied between times $t=t_8$ and $t=t_9$.

More specifically, at the beginning of an injection sequence, the solenoid coil 106 is unenergized, thereby permitting the spill valve spring 81 (which exerts a first spring force) to open the spill valve 80 such that an outer knife edge 197 of a conical poppet sealing surface 198 is spaced from a flat valve seat 200. Also at this time, the DOC valve spring 90 (which exerts a second spring force greater than the first spring force) moves the central tube 120 upwardly to a position whereby the outer knife edge 180 of the sealing surface 178 is spaced from the flat valve seat 182 and such that the conical sealing surface 172 is in sealing contact with the conical valve seat 174. Under these conditions, fuel enters the valve recess 146 from an inlet passage (not shown) and thereafter flows through a plunger passage 208 (FIG. 2), passages 210, 212 in the plunger 82 and an annular groove 214 surrounding the plunger 82 to drain. At this time, fuel also flows to drain through the passage 144, the recess 148 and an annular space 152 about the central tube 120. Subsequently, the lobe on the cam pushes down on the plunger 82 of the injector 20, taking the passages 210, 212 in the plunger 82 out of fluid communication with the annular groove 214, so that fuel pressurization can then take place. The current waveform portion 192 is then delivered to the solenoid coil 106 by the drive circuit 196. The pull-in and holding current levels of the portion 192 and the valve springs 81, 90 are selected such that the motive force developed by the first armature 108 exceeds the-first spring force developed by the spring 81 but the motive force developed by the second armature 110 is less than the second spring force developed by the spring 90. Consequently the first armature 108 moves upwardly against the washer 142 and closes the spill valve 80. At this point, the outer knife edge 197 is moved into sealing contact with the flat seat 200, thereby isolating the plunger passage 208 from the valve recess 146. Also during this time, because the valve spring 90 exerts a greater spring force than the force developed by the second armature 110, the DOC valve 88 remains in the previously described condition. Fluid pressurized by downward movement of the plunger 82 is thereby delivered through the plunger passage 208 and a central passage 220 in the central tube 120 to first and second check end passages 222, 224 leading to bottom and top ends, respectively, of the check assembly to substantially balance fluid pressures on the ends of the assembly. The spring 86 urges the check to remain closed at this time.

The drive circuit 196 thereafter delivers the second current waveform portion 194 to the solenoid coil 106. This increased current level develops an increased force on the second armature 110 which exceeds the second spring force, causing such armature to move downwardly. This downward movement is transmitted by the drive washer 160 and the retaining ring 162 to the valve 88 to cause the valve 88 also to move downwardly such that the outer knife edge 180 is moved into sealing contact with the flat valve seat 181. In addition, the conical sealing surface 172 moves out of sealing contact with the valve seat 174. The effect of this movement is to isolate the second check end passage 224 from the high pressure fluid in the central passage 220 and to permit fluid communication between the second check end passage 224 and the passage 150 in fluid communication with drain (the connection between the passage 150 and drain is not shown in the Figures). The pressures across the check then become unbalanced, thereby driving the check upwardly and permitting fuel to be injected into an associated cylinder.

When injection is to be terminated, the current delivered to the solenoid coil 106 may be reduced to the holding level of the first current waveform portion 192 as illustrated in FIG. 4. If desired, the current delivered to the solenoid coil 106 may alternatively be reduced to zero or any other level less than the first holding level. In any event, the DOC valve 88 first moves upwardly, thereby reconnecting the second check end passage 224 to the passage 222. The fluid pressures across the check assembly thus become substantially balanced, thereby allowing the check spring 86 to close the check 84. The current may then be reduced to zero or any other level less than the first holding level (if it has not already been so reduced). Regardless of whether the applied current is immediately dropped to the first holding level or to a level less than the first holding level, the spill valve spring 81 opens the spill valve 80 after the DOC spring 90 moves the DOC valve 88 upwardly.

If desired, the solenoid coil may receive more than two current waveform portions to cause multiple armatures (not just two) to move and thereby operate one or more valves or other movable elements. Further, the spill valve 80 could be replaced by a hydraulic latch nail valve, if desired.

Still further, multiple or split injections per injection cycle can be accomplished by supplying suitable waveform portions to the solenoid coil 106. For example, the first and second waveform portions 192, 194 may be supplied to the coil 106 to accomplish a pilot or first injection. Immediately thereafter, the current may be reduced to the first holding current level and then increased again to the second pull-in and second holding levels to accomplish a second or main injection. Alternatively, the pilot and main injections may be accomplished by initially applying the waveform portions 192 and 194 to the solenoid coil 106 and then repeating application of the portions 192 and 194 to the coil 106. The durations of the pilot and main injections (and, hence, the quantity of fuel delivered during each injection) are determined by the durations of the second holding levels in the waveform portions 194. Of course, the waveform shapes shown in FIG. 4 may be otherwise varied as necessary or desirable to obtain a suitable injection response or other characteristic.

As should be evident from the foregoing, the design of the solenoid 100 permits the central passage 220 to be substantially coincident with the central axis of the fuel injector 20 and is aligned at first and second ends with the ends of the plunger passage 208 and the first check end passage 222, respectively. Because fuel is directed along the center of the injector, high pressure intersecting holes and plugs are not required. Further, there is no need to align the lower valve seat of the DOC valve 88. The valve can be made with fewer parts and the number of steps required to manufacture the valve is reduced. Because the fuel passages do not pass around the outside of the solenoid, more space is available for other components, such as a wiring connector 240 for connecting the solenoid coil to the drive circuit 196.

While the fuel injector of the present invention utilizes flat seats which may require more sealing force than valves utilizing conical seats, and while the response of the DOC valve 88 may be slower than DOC valves of previous designs due to increased mass, it is felt that these potential disadvantages can be outweighed by the advantages noted above.

Numerous modifications and alternative embodiments of the present invention will be apparent to those skilled in the art in view of the foregoing description. Accordingly, this description is to be construed as illustrative only and is for the purpose of teaching those skilled in the art the best mode of carrying out the invention. The details of the structure and/or function may be varied substantially without departing from the spirit of the invention, and the exclusive use of all modifications which come within the scope of the appended claims is reserved.

We claim:

1. A fuel injector solenoid, comprising:

a stator having first and second axially-spaced outer arms;

a solenoid coil disposed in the stator; and first and second axially adjacent armatures disposed between the outer arms and having complementary surfaces defining a non-axial armature gap between the armatures wherein the armatures are movable in an axial direction away from one another in response to current flowing in the solenoid coil.

2. The fuel injector solenoid of claim 1, wherein the first and second outer arms include first and second stator faces opposite first and second armature faces, respectively, to define first and second airgaps.

3. The fuel injector solenoid of claim 1, wherein the complementary surfaces comprise opposed radial surfaces.

4. The fuel injector solenoid of claim 1, wherein the complementary surfaces define a single step.

5. The fuel injector solenoid of claim 1, wherein the complementary surfaces define a plurality of steps.

6. The fuel injector solenoid of claim 1, further including a flux blocking element disposed between the armatures.

7. The fuel injector solenoid of claim 6, wherein the flux blocking element is disposed between axial surfaces of the complementary surfaces.

8. A fuel injector solenoid, comprising:

a stator having first and second outer arms;

a solenoid coil disposed in the stator; and first and second axially adjacent armatures disposed between the outer arms and having complementary stepped surfaces defining an armature gap between the armatures wherein the armatures are movable in an axial direction away from one another in response to current flowing in the solenoid coil.

9. The fuel injector solenoid of claim 8, wherein the first and second outer arms include first and second stator faces opposite first and second armature faces, respectively, to define first and second airgaps.

10. The fuel injector solenoid of claim 8, wherein the complementary stepped surfaces include opposed radial surfaces and opposed axial surfaces.

11. The fuel injector solenoid of claim 10, wherein a radial flux path having a first reluctance extends between the opposed radial surfaces and an axial flux path having a second reluctance greater than the first reluctance extends between the opposed axial surfaces.

12. The fuel injector solenoid of claim 8, wherein the complementary stepped surfaces define a single step.

13. The fuel injector solenoid of claim 8, wherein the complementary stepped surfaces define a plurality of steps.

14. The fuel injector solenoid of claim 8, further including a flux blocking element disposed between the armatures.

15. The fuel injector solenoid of claim 14, wherein the flux blocking element is disposed between axial surfaces of the complementary stepped surfaces.

16. A fuel injector solenoid, comprising:

a stator having first and second outer arms;

a solenoid coil disposed in the stator; and first and second axially adjacent armatures disposed between the outer arms and having complementary stepped surfaces including opposed radial surfaces and opposed axial surfaces together defining an armature gap between the armatures wherein the armatures are movable in an axial direction away from one another in response to current flowing in the solenoid coil;

wherein the first and second outer arms include first and second stator faces opposite first and second armature faces, respectively, to define first and second airgaps and wherein a radial flux path having a first reluctance extends between the opposed radial surfaces and an axial flux path having a second reluctance greater than the first reluctance extends between the opposed axial surfaces.

17. The fuel injector solenoid of claim 16, wherein the complementary stepped surfaces define a single step.

18. The fuel injector solenoid of claim 16, wherein the complementary stepped surfaces define a plurality of steps.

19. The fuel injector solenoid of claim 16, further including a flux blocking element disposed between the armatures.

20. The fuel injector solenoid of claim 19, wherein the flux blocking element is disposed between axial surfaces of the complementary stepped surfaces.

* * * * *